US005131645A

United States Patent [19]

Ricciardi

[11] Patent Number: 5,131,645

[45] Date of Patent: Jul. 21, 1992

[54] SWEEPER ASSEMBLY FOR DOCUMENT CONVEYOR SYSTEM

[75] Inventor: Mario Ricciardi, Glenview, Ill.

[73] Assignee: Bell & Howell Company, Skokie, Ill.

[21] Appl. No.: 676,156

[22] Filed: Mar. 27, 1991

[51] Int. Cl.[5] ..... B65H 29/00

[52] U.S. Cl. ..... 271/181; 271/184; 414/798.5; 414/798.6; 414/798.7

[58] Field of Search ..... 271/3.1, 163, 181, 225, 271/149, 150, 184, 221, 2; 414/798.5, 798.6, 798.7, 798.2, 798.9

[56] References Cited

U.S. PATENT DOCUMENTS 3,131,932 5/1964 Maidment ..... 271/181 X
3,865,365 2/1975 Hardin et al. ..... 414/798.5 X
4,019,730 4/1977 Staudinger et al. ..... 271/181
4,518,160 5/1985 Lambrechts et al. ..... 414/798.5 X
4,974,826 12/1990 Suyatsky et al. ..... 271/181 X

*Primary Examiner*—David H. Bollinger
*Attorney, Agent, or Firm*—Welsh & Katz, Ltd.

[57] ABSTRACT

A sweeper assembly for use in a document conveyor system having belt conveyor means operative to convey generally flat documents in upstanding on-edge relation to a stacker station. The sweeper assembly includes feed augers adapted to receive the lower edges of documents from the stacker station and move the lower edges of the documents into conveyor belt means operative to convey the documents to accelerator rollers which accelerate movement of the documents into a container.

16 Claims, 6 Drawing Sheets 10
16
22
24
26
30
30a
32a
32b
32c
34a
34b
34c
38
38a
38b
40
42
46
48a
48b
50a
50b
52a
52b
60
62a
62b
64
66a
66b
68
70
70a
76
78
80a
80b
82b
84
86
88
92
92a
94a
94b
96
102a
104
104a
110a
110b
112a
112b
114
114a
116
116a
118
3
4

16'
14'
140b
136b
138
38
38b
140a
136a
32b
32c
32a
60
66a
62a
30
132a
144
144a
12
26'
36
134a
132
30a
142
24
134
158
158a
176c
180b
22a
152
158b
22
62b
162a
160a
150
156b
176b
142a
26'a
156a
156
172b
164
178
160b
172a
168b
176a
170b
180a
170a
168b
130
178a
168a
174

SWEEPER ASSEMBLY FOR DOCUMENT CONVEYOR SYSTEM

BACKGROUND OF THE INVENTION

The present invention relates generally to document handling systems having belt conveyors for conveying flat documents on edge, and more particularly to a novel sweeper assembly for sweeping documents from the stacker station of a document conveying and sorting system for deposit into a document receiving container or the like.

Conveying systems are generally known which convey documents, such as mailing envelopes and the like, on edge along a main or primary conveyor path from which the documents may be selectively diverted or sorted and conveyed to a predetermined position, such as a stacker station, at which one or more documents are maintained in upstanding relation. Conventionally, when a plurality of documents have been conveyed to the stacker station, they are removed for placement in a container or the like for subsequent handling. If documents at the stacker station are not regularly removed, the documents may back-up in the conveyor path or otherwise be damaged by the conveyor belts attempting to move them into the stacker station when prior documents in the stacker station prevent receipt of additional documents. This problem is particularly acute when conveying relatively large size documents, such as $8\frac{1}{2}\times 11$ inch rectangular envelopes or larger, which are relatively thick, such as up to three-eighths inch thick or more, and relatively inflexible or stiff. Such documents require relatively continuous removal from the stacker station because of their size and accumulated weight. Thus, there exists a need for a sweeper mechanism capable of removing documents disposed in upstanding on-edge relation at a stacker station and automatically conveying the documents to a container or the like.

SUMMARY OF THE INVENTION

One of the primary objects of the present invention is to provide a novel sweeper assembly for use in a conveyor system to automatically sweep documents from a stacker station into a receiving container or the like.

A more particular object of the present invention is to provide a novel sweeper assembly for use with a document conveyor system operative to automatically convey documents in generally upstanding on-edge relation to a stacker station, the sweeper assembly being operative to sweep the documents from the stacker station in generally sequential fashion to a receiving container or bin.

Another object of the present invention is to provide a novel sweeper assembly which finds particular application in sweeping relatively large flat documents from a stacker station to which the documents are conveyed in upstanding on-edge relation, the sweeper assembly having feeder means in the form of feed augers adapted to receive the lower edges of documents from the stacker station and feed the documents to conveyor belts which convey the documents to accelerator rollers for accelerated movement into a container or bin.

A feature of one embodiment of a sweeper assembly in accordance with the present invention lies in the provision of a pair of conveyor belts having overlapping reaches which define a nip to receive the lower edges of documents from feeder means and positively grip and convey the documents to accelerator rollers which accelerate movement of the documents into a receiving container or the like.

A further feature of the sweeper assembly in accordance with the present invention lies in its combination with a stacker station of a document handling conveyor belt system having means to maintain one or more documents in generally upstanding relation and effect movement to positions wherein the lower edges of the documents are engaged by feed augers which feed the documents onto conveyor belt means for conveying the documents to accelerator rollers operative to accelerate movement of the documents into a container or the like.

Further objects, features and advantages of the present invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
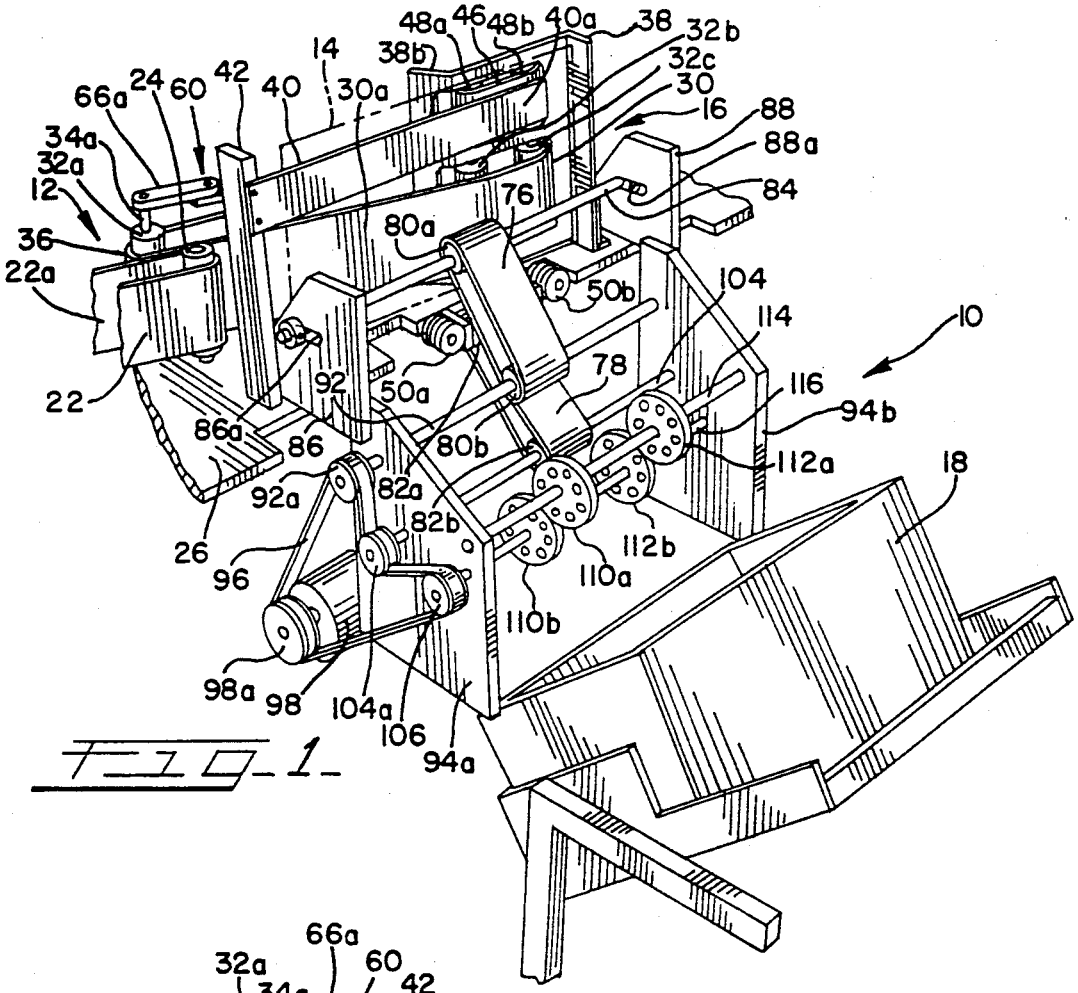
FIG. 1 is fragmentary perspective view illustrating a sweeper assembly constructed in accordance with the present invention in operative association with a stacker station of a document conveyor system.
Figure 5:
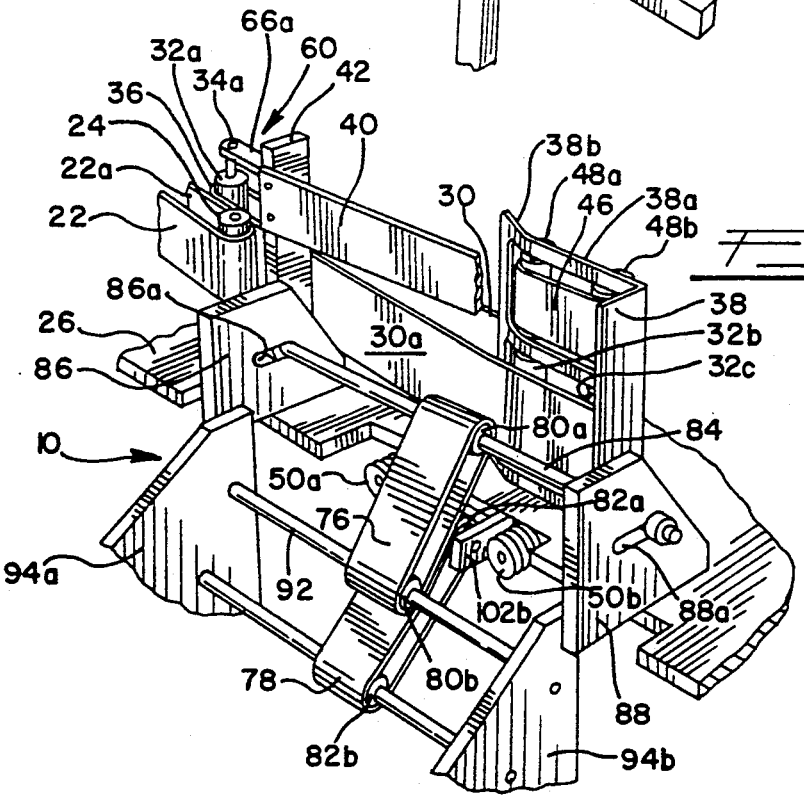
FIG. 5 is a fragmentary perspective view of the sweeper assembly as illustrated in FIG. 1, but from a different perspective and with portions broken away for purposes of clarity.

Referring now to the drawings, and in particular to FIG. 1, a sweeper assembly constructed in accordance with one embodiment of the present invention is indicated generally at 10. The sweeper assembly 10 is illustrated in conjunction with, and forms a part of, a document handling system which includes conveyor means, indicated generally at 12, operative to convey documents, such as mailing envelopes and flats, one of which is illustrated in phantom at 14, to a predetermined path position as defined by a stacker station, indicated generally at 16. The sweeper assembly 10 finds particular application with document conveying systems which sort generally flat documents of approximately $8\frac{1}{2}\times 11$ inch size and which may be up to $\frac{3}{8}$ inch thick or more. However, with component size modifications as necessary, the system may also be employed to sort conventional letter size envelopes.

The sweeper assembly 10 is operative to sweep documents 14 disposed in upstanding on-edge relation within the stacker station 16 into a document receiving container which, in the illustrated embodiment, takes the form of a generally rectangular l open-top container 18. The sweeper assembly 10 deposits the documents in stacked relation within the container which may periodically be removed, as when full, for further processing of the documents.

The conveyor means 12 may form a portion of a document handling system which includes a feeder station (not shown) from which documents are fed one-at-a-time in an upstanding on-edge condition to a reader station (not shown). The reader station may include an optical character reader or bar code reader for reading indicia on the individual documents, such as printed addresses or bar codes representative of a mailing zip code destination.

The document handling system may include conveyor belt means defining a primary or main conveyor path along which documents are initially conveyed and from which the documents are selectively diverted or sorted at diverter or sorter stations positioned along the length of the primary conveyor path. The conveyor means 12 is representative of a portion of one diverter or sorter station to which documents are diverted from the primary conveyor path for passage in upstanding on-edge relation to a predetermined position such as the stacker station 16. To this end, the conveyor means 12 includes a secondary conveyor belt 22 which is supported by upstanding rollers, one of which is indicated at 24, so as to define a reach 22*a* disposed vertical to a base plate 26 and generally inclined to the direction of the primary conveyor path. The roller 24 for belt 22 may be rotatably driven to effect longitudinal movement of the belt 22 at a belt speed substantially equal to the speed of the corresponding primary conveyor belt (not shown). A more detailed description of a primary conveyor path defined by primary conveyor belts, and having one or more document diverter stations along its length as defined by secondary conveyor belts and associated diverter mechanisms is provided in copending application, Ser. No. 07/676,157, filed of even date herewith and entitled DIVERTER MECHANISM FOR FLAT DOCUMENT CONVEYOR SYSTEM which is incorporated herein by reference.

Figure 2:
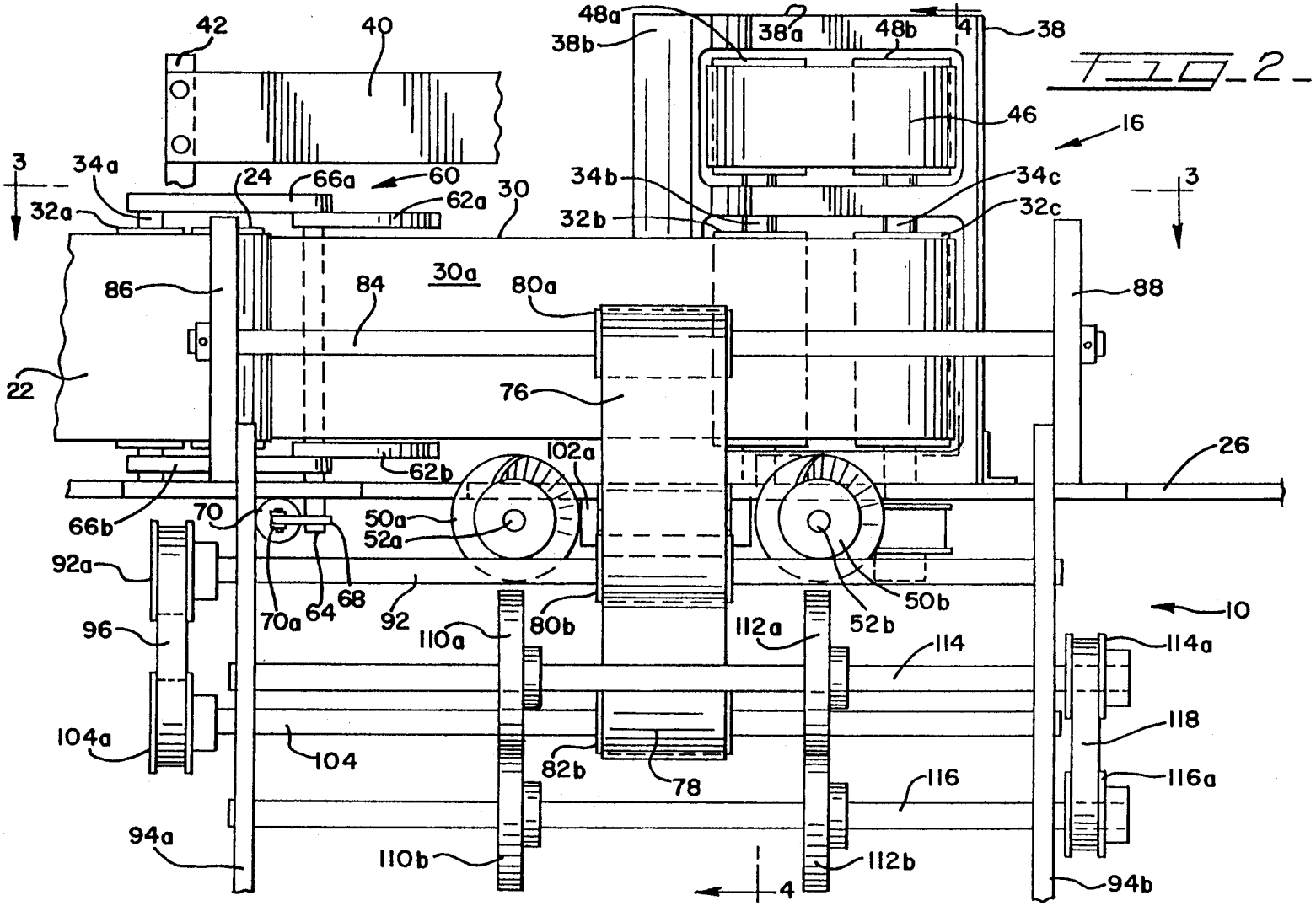
FIG. 2 is a fragmentary elevational view of the sweeper assembly illustrated in FIG. 1 but with portions broken away for purposes of clarity.
Figure 3:
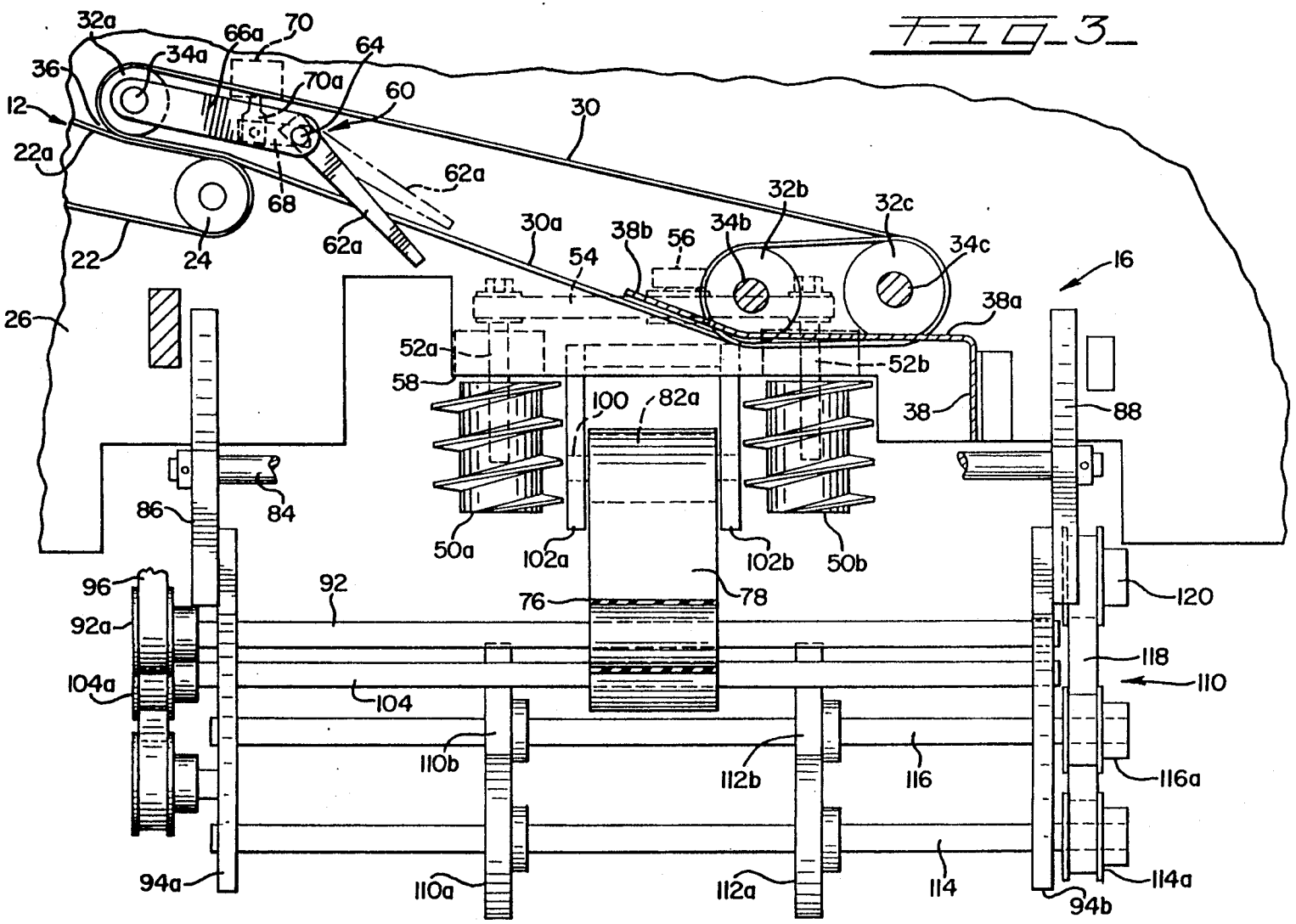
FIG. 3 is a fragmentary horizontal sectional view taken substantially along line 3—3 of FIG. 2.

The stacker station 16 includes an endless conveyor belt 30 which is supported by rollers 32*a*, 32*b* and 32*c* rotatable about vertical axles 34*a*, 34*b* and 34*c*, respectively (FIG. 3). The belt support rollers 32*a–c* are positioned to establish a stacker station belt reach 30*a* which partially overlaps reach 22*a* of the secondary conveyor belt 22 so as to define a nip 36 between belts 22 and 30 to receive the leading edges of documents diverted along the diverter reach 22*a* of the secondary conveyor belt. The rollers 24 and 32*c* may be rotatably driven at equal rotational speeds but in opposite rotational directions such that the overlapping or juxtaposed portions of the belt reaches 22*a* and 30*a* move in the same direction. Roller 32*c* may have a larger diameter belt driving surface than roller 24 to impart a greater longitude speed to belt 30 than the secondary conveyor belt 22. In this manner, documents entering the nip 36 and advancing between the overlapping belt reaches 22*a* and 30*a* are caused to undergo accelerated movement as they exit from the overlapping belt reaches which imparts sufficient momentum to the documents to carry them with belt reach 30*a* to a position wherein their leading edges engage an upstanding stop 38 within the stacker station 16. The stop 38 has a right-angle lead-in arm or plate 38*a* having a free end 38*b* and rectangular openings which enable the arm 38*a* to lie in a plane slightly rearwardly of the plane of belt reach 30*a* as it passes between rollers 34*b* and 34*c*, as illustrated in FIGS. 1–3.

To ensure that documents, such as illustrated in phantom at 14 in FIG. 1, are maintained in generally upright on-edge relation after being conveyed to the stacker station 16, a flexible spring bar or arm 40 is supported at one end by an upstanding support bracket 42 such that the spring bar extends in parallel spaced relation to the base plate 26 and lies in a plane generally normal to the plane of the stop member 38. The free end 40*a* of spring bar 40 is positioned to lightly engage an endless conveyor belt 46 which is supported on rollers 48*a* and 48*b* mounted on the upper ends of the roller axles 34*b* and 34*c*, respectively. The rollers 48*a* and 48*b* are substantially equal in diameter to the corresponding rollers 32*b* and 32*c* so that belt 46 is driven in the same direction and speed as conveyor belt 30. Belt 46 has a reach generally coplanar with the reach of belt 30 disposed between rollers 32*b* and 32*c*, and cooperates with the free end 40*a* of spring bar 40 to frictionally engage the forward ends of documents received between belt 46 and the spring bar so as to prevent rebound of documents 14 when their leading edges abut the stop 38. In this manner, one or more documents 14 disposed in the stacker station 16 are maintained in generally upstanding on-edge relation against the reach 30*a* of belt 30 preparatory to being swept into the container 18 by the sweeper assembly 10.

Figure 4:
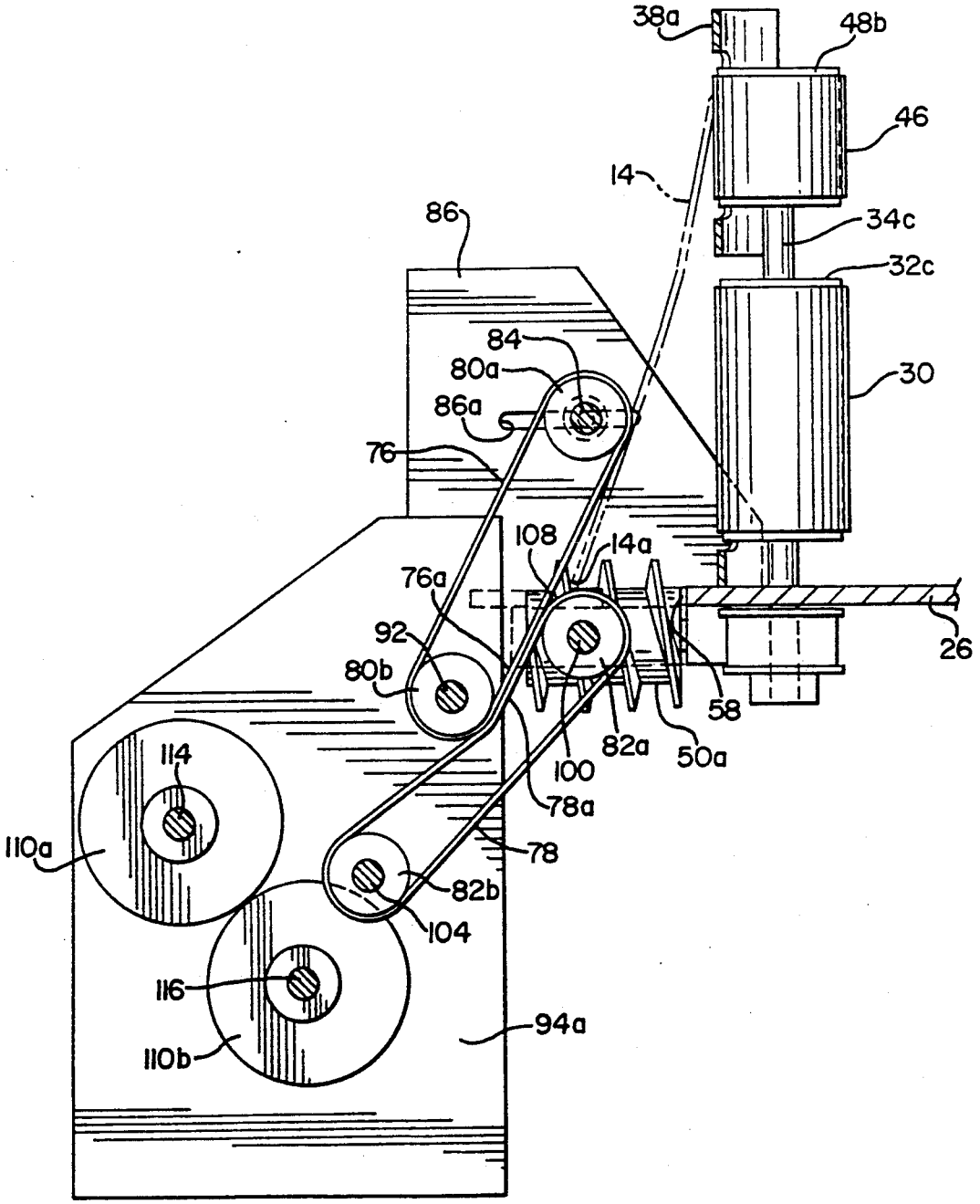
FIG. 4 is a vertical sectional view taken substantially along the line 4—4 of FIG. 2.

To initiate movement of a document into and through the sweeper assembly 10, the sweeper assembly includes feeder means in the form of at least one, and preferably two, substantially identical feed augers 50*a* and 50*b* which are supported on respective drive shafts 52*a* and 52*b* supported beneath the base plate 26 such that the rotational axes of the feed augers are parallel and lie in a plane substantially parallel to and spaced below the base plate 26. The rotational axes of augers 50*a* and 50*b* are spaced sufficiently below the base plate 26 so that only the helical worms on the respective feed augers extend above the upper surface of the base plate, as illustrated in FIGS. 2 and 4. The outer ends of the auger drive shafts 52*a* and 52*b* have drive pulleys thereon which are connected through a drive belt 54 to a suitable drive motor, indicated schematically at 56 in FIG. 3, so as to effect clockwise rotation of the feed augers, as considered in FIG. 2.

As illustrated in FIGS. 3 and 4, the in-feed ends of the feed augers 50*a* and 50*b* are disposed adjacent a recessed edge surface 58 of the base plate 26 which lies in a plane spaced forwardly from and generally parallel to a vertical plane containing the reaches of the stacker station belts 30 and 46 disposed between their respective support pulleys 32*b,c* and 48*a,b*. Such spacing is provided to enable one or more documents fed into the stacker station along the stacker belt reach 30*a* to fully engage the stop 38 before being swept from the stacker station by the sweeper assembly 10.

To effect movement of the lower edges of documents 14 disposed within the stacker station 16 into engagement with the feed augers 50*a* and 50*b*, kicker arm means, indicated generally at 60, is provided at the stacker station 16 to effect lateral movement of each document disposed within the stacker station with its leading edge engaging the stop 38. Referring to FIGS. 2 and 3, the kicker arm means 60 includes a pair of kicker arms 62*a* and 62*b* which are fixed in radial relation to a pivot shaft 64. The pivot shaft 64 is supported by and between a pair of support arms 66*a* and 66*b* and extends below the base plate 26. An actuating arm 68 is fixed on the lower end of pivot shaft 64 and has its outer end connected to control means in the form of an actuating solenoid 70 supported below the base plate 26 and having a solenoid actuating rod 70*a* pivotally connected to arm 68. The kicker arms 62*a* and 62*b* are supported above and below, respectively, the longitudinal marginal edges of conveyor belt 30 and are biased to positions extending forwardly from the belt reach 30*a* by spring means disposed within the solenoid 70, or otherwise acting on the actuating arm 68 externally of the actuating solenoid.

The solenoid 70 is connected in a control circuit adapted to effect energizing of the solenoid to move the kicker arms 62*a,b* to positions rearwardly of the belt reach 30*a* upon detection of the leading edge of a document entering the nip 36 between belt reaches 22*a* and 30*a*. The leading edge of a document entering nip 36 is detected by sensor means in the form of a photocell (not shown) positioned adjacent belt pulley 32*a*. Detection of the trailing edge of the same document (or the last of a group of documents conveyed in side-by-side relation through overlapping belt reaches 22*a* and 30*a*) by the sensor means serves to de-energize the solenoid 70 and allow the spring biasing means to effect a snap-action or kick movement of the kicker arms to their forward positions engaging the trailing portions of documents disposed in the stacker station 16. This action serves to move the trailing portion of each documents disposed in the stacker station laterally outwardly from the belt reach 30*a* with sufficient force to orient the document transversely of the longitudinal axis of the sweeper assembly and effect engagement of the lower edge 14*a* of each document with the feed augers 50*a,b*.

With the lower edges 14*a* of one or more flat documents 14 engaging the feed augers 50*a* and 50*b*, the feed augers feed the documents outwardly from the conveyor belt 30 as shown for a single document illustrated in phantom in FIG. 4. The feed augers 50*a* and 50*b* feed the lower edge 14*a* of each successive document 14 into conveyor means which, in the embodiment illustrated in FIGS. 1-5, includes a pair of conveyor belts 76 and 78 supported on corresponding pairs of rollers 80*a,b* and 82*a,b*. Roller 80*a* is an idler roller rotatably supported on a horizontal support shaft 84 having its opposite ends received within longated slots 86*a* and 88*a* in upstanding support plates 86 and 88, respectively. Suitable fastening means are fixed to the opposite ends of support shaft 84 to enable fixed adjustment within the corresponding slots 86*a* and 88*a* for adjusting the position of idler roller 80*a*. Roller 80*b* is fixed on a horizontal drive shaft 92 which is rotatably supported by and between a pair of upstanding frame plates 94*a* and 94*b*. An end of the drive shaft 92 extends outwardly from the frame plate 94*a* and has a pulley 92*a* fixed thereon for driving relation with an endless timing belt 96 which is reeved about a drive pulley 98*a* fixed on the drive shaft of a suitable drive motor 98.

The support roller 82*a* for belt 78 is supported as a rotatable idler roller on a horizontal support shaft 100 having its opposite ends supported by brackets 102*a* and 102*b* fixed to the base plate 26. Roller 82*a* is positioned so that a horizontal plane tangent to the outer peripheral service of roller 82*a* at its uppermost point is substantially coplanar with the upper surface of the base plate. The belt support roller 82*b* serves as a drive roller for the belt 78 and is supported on a horizontal rotatable shaft 104 having an end extending outwardly from the frame plate 94*a* on which a drive pulley 104*a* is mounted. Pulley 104*a* is driven by belt 96 so that the drive rollers 80*b* and 82*b* are driven at equal rotational speeds but in opposite rotational directions. An idler pulley 106 is supported on frame plate 94*a* to facilitate proper training of drive belt 96 about pulleys 92*a* and 104*a*.

As illustrated in FIG. 4, the conveyor belts 76 and 78 are supported so as to establish mutually overlapping and contacting reaches 76*a* and 78*a* which define a nip 108 positioned to receive the bottom edges 14*a* of successive documents 14 fed outwardly from the stacker station 16 by the fed augers 50*a* and 50*b*. As the bottom edge 14*a* of each document is fed into the nip 108, the corresponding flat document is positively gripped by the juxtaposed belt reaches 76*a* and 78*a* and fed downwardly at an inclined angle from horizontal. The leading edge of the document conveyed downwardly by conveyor belts 76 and 78 is engaged by accelerator means in the form of pairs of equal diameter accelerator rollers 110*a,b* and 112*a,b*. The accelerator rollers 110*a,b* and 112*a,b* effect accelerated movement of documents from the conveyor belts 76 and 78 into the container 18. The rollers 110*a* and 112*a* are fixed in axially aligned relation on a horizontal drive shaft 114 having an end extending outwardly from the frame plate 94*b* on which a drive pulley 114*a* is fixed, as illustrated in FIGS. 2 and 3.

The accelerator rollers 110*b* and 112*b* are fixed on a horizontal drive shaft 116 which similarly extends outwardly from frame plate 94*b* and has a drive pulley 116*a* fixed thereon. The drive pulleys 114*a* and 116*a* are of equal diameter and are interconnected through a drive belt 118 driven by a drive pulley 118 fixed on the drive shaft of a suitable drive motor (not shown) such that the pairs of accelerator rollers 110*a,b* and 112*a,b* are driven at equal rotational speeds but in opposite rotational directions. The accelerator rollers 110*a,b* and 112*a,b* are preferably made from a suitable plastic or rubber material and have holes formed therethrough in circumferentially spaced relation about their center axes to provide relatively high friction resilient engagement with one or more documents received between the corresponding pairs of accelerator rollers.

Figure 6:
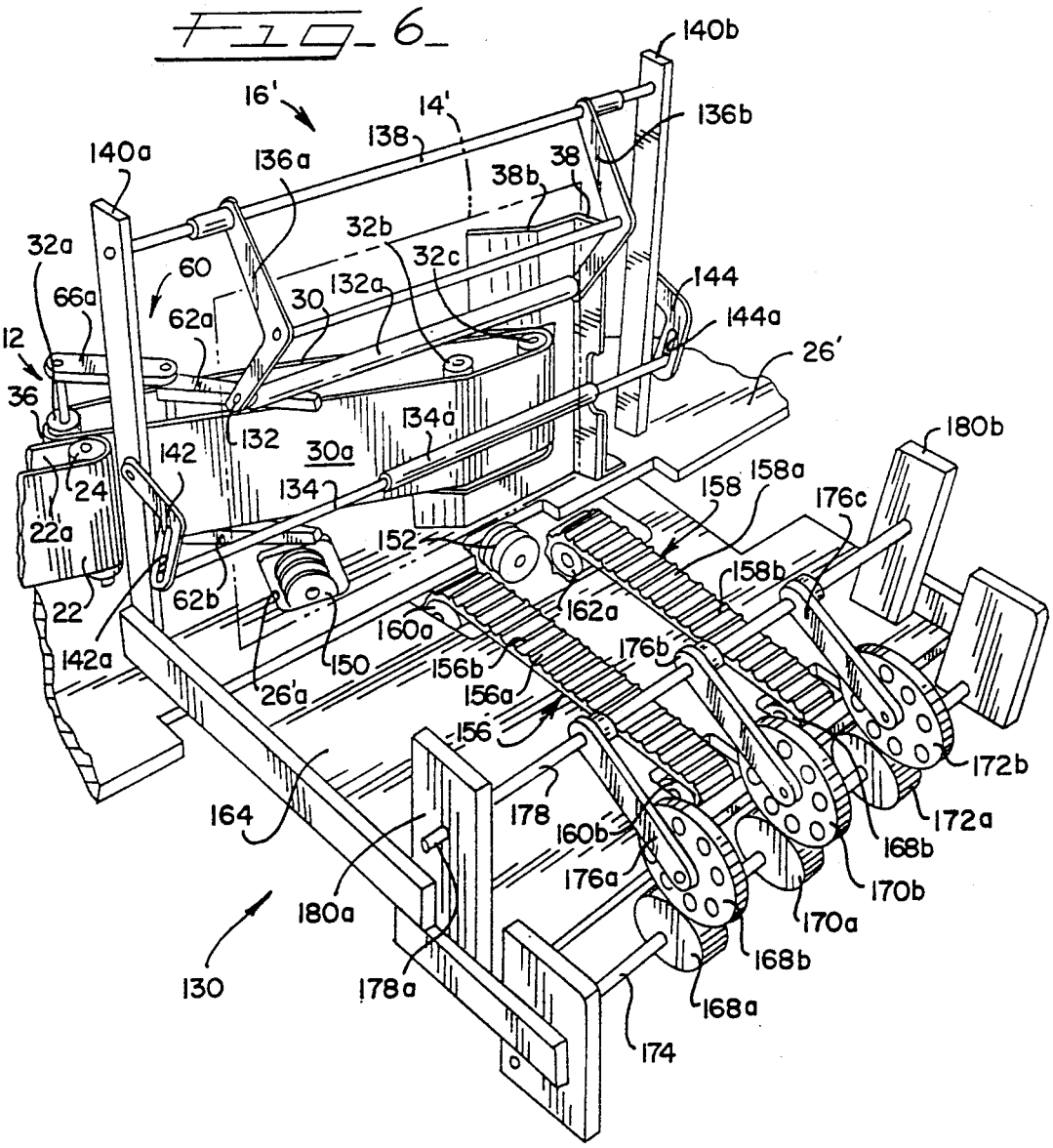
FIG. 6 is a fragmentary perspective view of an alternative sweeper station constructed in accordance with the present invention and shown in operative association with a portion of a document conveyor system.
Figure 7:
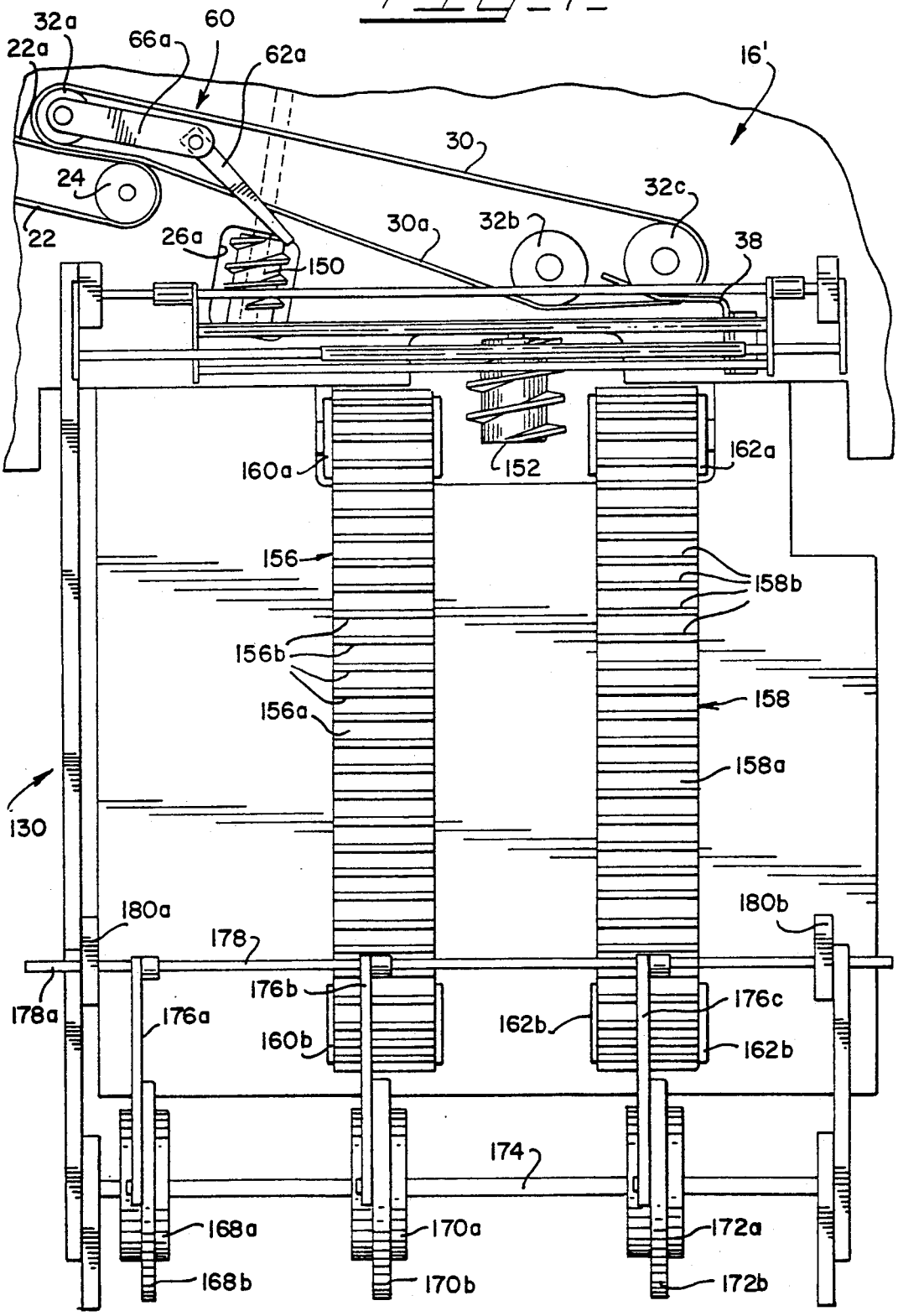
FIG. 7 is a plan view of the sweeper station and associated fragmentary document conveyor system illustrated in FIG. 6.

Having thus described the sweeper assembly 10, it will be understood that employment of conveyor belt means in the form of the conveyor belts 76 and 78 having overlapping reaches 76*a* and 78*a* enables the documents 14 to be fed in a downwardly inclined direction toward the container 18 through a positive gripping action of the conveyor belts. Use of the inclined conveyor belts 76, 78 in the described manner enables a relatively compact sweeper assembly to be provided which requires significantly less floor space for the corresponding document handling system. Further, by utilizing the conveyor belts 76 and 78 in cooperation with the feed augers 50*a* and 50*b* and kicker arm means 60, automatic sweeping of generally flat documents 14 from the stacker station 16 is effected, with the documents being accelerated into the container 18 by the accelerator roller 110*a,b* and 112*a,b*. It will be further understood that the sweeper assembly 10 may sweep individual documents 14 from the stacker station 16 or simultaneously sweep more than one document when disposed in the stacker station The feed augers 50*a* and 50*b* are sized to receive the lower edges of a plurality of documents 14 and feed them simultaneously to the nip 108 of conveyor belts 76 and 78. As described, the ac-celerator rollers 110*a,b* and 112*a,b* are adapted to receive and accelerate either individual documents or a plurality of documents simultaneously. FIGS. 6 and 7 illustrate an alternative embodiment of a sweeper assembly, indicated generally at 130, constructed in accordance with the present invention. The sweeper assembly 130 is employed with a document handling system adapted to convey flat documents, such as mailing envelopes and the like, in generally upstanding on-edge relation along a main or primary conveyor path and having one or more document diverter or sorting stations. Each document diverter station includes a secondary conveyor belt, such as indicated at 22, for conveying diverted or sorted documents to a stacker station 16' from which the documents are swept by the sweeper assembly 130 to a container (not shown) in similar fashion to the document handling system with which the sweeper assembly 10 is employed. Elements of the document conveying system with which the sweeper assembly 130 is employed that are substantially identical to corresponding elements described in conjunction with FIGS. 1–5 are represented by identical reference numbers.

A difference between the stacker station 16 illustrated in FIGS. 1–5 and the stacker station 16' illustrated in FIGS. 6 and 7 is that the spring bar 40 employed in stacker station 16 is replaced in the stacker system 16' with a pair of horizontal rods 132 and 134 which assist in maintaining one or more flat documents 14' in generally upstanding on-edge relation at the stacker station 16' as the documents are fed to the sweeper assembly 130. The rod 132 preferably carries a rotatable plastic sleeve 132*a* and is supported by a pair of generally L-shaped arms 136*a* and 136*b* which have their lower ends connected to opposite ends of the shaft 132. The opposite upper ends of arms 136*a,b* are pivotally supported on a horizontal support shaft 138 having its opposite ends fixed to upstanding brackets 140*a* and 140*b*. The support arms 132*a,b* allow rod 132 and the associated rotatable sleeve 136*a* to be urged by gravity to a position wherein the sleeve 132*a* lies generally in a vertical plane parallel to and spaced slightly outwardly from the reach of belt 30 disposed between the support rollers 32*b* and 32*c*, thereby assisting in maintaining one or more documents 14, in upstanding relation within the stacker station 16'.

The rod 134 also carries a rotatable plastic sleeve 134*a* and has its opposite ends longitudinally fixed but vertically slidable in elongated slots 142*a* and 144*a* formed, respectively, in generally L-shaped support brackets 142 and 144 as illustrated in FIG. 6. The support rod 34 and associated sleeve 134*a* are supported to lie generally in a vertical plane containing the axis of rod 132 and thus assists in maintaining a document 14' in upstanding relation within the stacker station 16'.

When one or more documents 14, are disposed within the stacker station 16' with their leading edges engaging the stop 38, the kicker arms 62*a* and 62*b*, which were retracted to positions behind the plane of belt reach 30*a* when the leading edges of the one or more documents were detected as the documents entered the nip 36 between the juxtaposed belt reaches 22*a* and 30*a*, are released in response to detection of the trailing edge of the last of the one or more documents entering the stacker station 16'. The kicker arms 62*a,b* kick the documents 14' laterally outwardly from the belt reach 30*a* sufficiently to effect engagement of the lower edge 14'*a* of each document with feeder means in the form of a first feed auger 150 which is supported beneath and parallel to the base plate 26' so that the external helical worm on the auger extends above the upper surface of base plate 26' through a suitable opener 26'*a*. The feed auger 150 is adapted to be rotated about its longitudinal axis which lies in a vertical plane forming an included angle of approximately 75 degrees with the plane of the inclined belt reach 30*a* between rollers 32*a* and 32*b*. The feed auger 150 is positioned to receive the lower edge 14'*a* of a document kicked laterally forwardly from the belt reach 30*a* by the kicker arm means 60 when the document is disposed within the stacker station 16'.

The feeder means of the sweeper assembly 130 includes a second feed auger 152 which is substantially identical to feed auger 150 and which is similarly supported below the base plate 26' so that its rotational axis is parallel to the direction of movement which a document undergoes as it is conveyed through the sweeper assembly 130 to a container. As illustrated in FIG. 7, the feed auger 150 is positioned closer to the belt reach 30*a* than feed auger 152 so that the lower edges of documents kicked outwardly from belt reach 30*a* first engage feed auger 150 which feeds the lower edges of the documents into the feed auger 152 which continues feeding the lower edges of the documents onto conveyor means in the form of a pair of substantially parallel endless conveyor belts 156 and 158. During feeding of documents from stacker station 16' onto the conveyor belts 156 and 158, the upper portions of the documents are guided by the sleeves 132*a* and 134*a*.

The conveyor belts 156 and 158 are supported by respective pairs of rollers 160*a,b* and 162*a,b* so that upper reaches 156*a* and 158*a* of the conveyor belts lie in coplanar relation above a base plate 164 of the sweeper station 130. The rollers 160*a* and 162*a* are of equal diameter and are supported on axially aligned oppositely driven drive shafts of corresponding drive motors (not shown) such that the upper conveyor belt reaches 156*a* and 158*a* are generally coplanar with the upper surface of the base plate 26' at the support rollers 160*a* and 162*a*. The rollers 160*b* and 162*b* are of equal diameter to rollers 160*a*, 162*a* and may be supported for free rotation on a common support shaft (not shown). The rollers 160*b* and 162*b* are preferably supported so that the upper belt reaches 156*a* and 158*a* are inclined downwardly from the rollers 160*a*, 162*a* to rollers 160*b* and 162*b*.

The conveyor belts 156 and 158 have raised transverse ribs formed in generally equal spaced relation along their periphery, such as indicated at 156*b* and 158*b*, respectively. The transverse ribs 156*b* and 158*b* assist in feeding the lower leading edge of each successive document onto the conveyor belts 156 and 158 and positively conveying the documents along the longitudinal axis of the sweeper assembly 130.

When a document is conveyed along the longitudinal axis of the sweeper assembly 130 by the conveyor belts 156 and 158, the forward or leading edge of the document is received by accelerator means in the form of pairs of accelerator rollers 168*a,b*, 170*a,b* and 172*a,b*. Rollers 168*a*, 170*a* and 172*a* are fixed on a horizontal drive shaft 174 and cooperate with the corresponding rollers 168*b*, 170*b* and 170*c*, respectively, to define document receiving nips between the respective pairs of accelerator rollers. The drive shaft 174 is connected at on end to a suitable drive motor (not shown) to effect clockwise rotation of the rollers 168*a*, 170*a* and 172*a*, as viewed in FIG. 6.

The rollers 168*b*, 170*b* and 170*c* are rotatably supported by support arm 176*a,b* and c, respectively, which have their opposite ends fixed to a horizontal rotatable shaft 178. Shaft 178 is rotatably supported by upstanding brackets 180*a* and 180*b* and has one end, such as 178*a*, extending outwardly from bracket 180*a* to facilitate connection to spring means or the like (not shown) in a manner to bias the rollers 168*b*, 170*b* and 172*b* toward the corresponding accelerator rollers 168*a*, 170*a* and 172*a*. The rollers 168*a*, 170*a* and 172*a* are rotationally driven so that the linear speed of their outer peripheral surfaces accelerates movement of a document received from the conveyor belts 156 and 158 into a receiving container such as the aforedescribed container 18.

Summarizing the operation of the sweeper assembly 130, sweeping of documents from the stacker station 16' is effected by causing the lower edges of the documents to engage the feed augers 150 and 152 which feed the documents onto the conveyor belts 156 and 158. The conveyor belts 156, 158 convey the documents to the nips of the accelerator rollers 168*a,b*, 170*a,b* and 172*a,b* which accelerate movement of the documents into a receiving container. By effecting automatic actuation of the kicker arm means 60 in response to detection of the leading and trailing edges of documents conveyed to the stacker station 16', sweeping of documents from the stacker station to the container is effected automatically.

While preferred embodiments of the present invention have been illustrated and described, it will be understood that changes and modifications may be made therein without departing from the invention in its broader aspects. Various features of the invention are defined in the following claims.

What is claimed is:

1. In a document conveying system for conveying generally flat documents along a path defined by conveyor means operative to convey documents in generally upstanding on-edge relation to a predetermined position, the combination therewith comprising retaining means including a spring bar positioned to engage the upper region of a document disposed in said predetermined position, and a sweeper assembly for sweeping successive documents from said predetermined position and conveying said documents along a predetermined path to a container, said sweeper assembly including feeder means adapted to receive the lower edge of a document from said predetermined position and move the lower edge of the document along said predetermined path, and conveyor belt means operative to receive documents directly from said feeder means and convey said documents to a discharge position for deposit into the container, said spring bar being operative to retain the upper region of each document in generally upstanding relation as its corresponding lower region is moved longitudinally along said predetermined path by said feeder means.

2. A conveying system as defined in claim 1 wherein said predetermined position to which said documents are conveyed is defined by a stacker station having stop means adapted to be engaged by the leading edges of documents conveyed to said stacker station, and including means cooperative with said spring bar to prevent rebound of documents after they engage said stop means.

3. A conveying system as defined in claim 2 wherein said means cooperative with said spring bar to prevent rebound of said documents includes a longitudinally driven endless belt supported in juxtaposed relation to said spring bar and cooperative therewith to prevent rebound of a document after engaging said stop means.

4. In a document conveying system for conveying generally flat documents along a path defined by conveyor means operative to convey documents in generally upstanding on-edge relation to a predetermined position, the combination therewith comprising a sweeper assembly for predetermined position, and a sweeper assembly for sweeping successive documents from said predetermined position and conveying said documents along a predetermined path to a container, said sweeper assembly including feeder means adapted to receive the lower edge of a document from said predetermined position and move the lower edge of the document along said predetermined path, conveyor belt means adapted to receive documents directly from said feeder means and convey said documents along said predetermined path, and accelerator means adapted to receive documents from said conveyor belt means and accelerate movement of the documents to a discharge position for deposit into the container.

5. In a document conveying system for conveying generally flat documents along a path defined by conveyor means operative to convey documents in generally upstanding on-edge relation to a predetermined position, the combination therewith comprising a sweeping assembly for sweeping successive documents from said predetermined position and conveying said documents along a predetermined path to a container, said sweeper assembly including feeder mean adapted to receive the lower edge of a document from said predetermined position and move the lower edge of the document along said predetermined path, and conveyor belt means including a pair of conveyor belts defining a nip therebetween, said conveyor belts being supported such that said nip receives the lower leading edges of documents from said feeder means and effects movement of said documents toward the container.

6. A conveying system as defined in claim 5 wherein said conveyor belts have juxtaposed reaches mutually engaging each other so as to capture documents between said juxtaposed reaches after the documents enter said nip, and convey said documents toward the container.

7. In a document conveying system for conveying generally flat documents along a path defined by conveyor means operative to convey documents in generally upstanding on-edge relation to a predetermined position, the combination therewith comprising a sweeper assembly for sweeping successive documents from said predetermined position and conveying said documents along a predetermined path to a container, said sweeper assembly including feeder means comprising at least one feed auger having a substantially horizontal axis of rotation and adapted to receive the lower edge of a document from said predetermined position and move the lower edge of the document along said predetermined path, and conveyor belt means including a pair of conveyor belts defining juxtaposed mutually engaging reaches disposed at a downwardly inclined angle to the axis of said feed auger so as to receive and convey documents from said feed auger in a downwardly inclined direction toward the container.

8. A conveying system as defined in claim 7 wherein said sweeper assembly further includes accelerator means adapted to receive documents from said conveyor belts and effect accelerated movement of said documents toward the container.

9. A conveying system as defined in claim 8 wherein said accelerator means includes at least one pair of accelerator rollers defining a nip therebetween adapted to receive documents from said conveyor belts and accelerate movement of said documents toward the container.

10. A conveying system as defined in claim 8 wherein said accelerator means includes a plurality of pairs of said accelerator rollers defining coplanar nips adapted to simultaneously receive documents from said conveyor belts.

11. In a document conveying system for conveying generally flat documents along a path defined by conveyor means operative to convey documents in generally upstanding on-edge relation to a predetermined position, the combination therewith comprising a sweeper assembly for sweeping successive documents from said predetermined position and conveying said documents along a predetermined path to a container, said sweeper assembly including feeder means adapted to receive the lower edge of a document from said predetermined position and move the lower edge of the document along said predetermined path, and conveyor belt means including at least one conveyor belt having a document receiving end disposed adjacent said feeder means for receiving documents directly from said feeder means, said conveyor belt having transverse ribs thereon operative to engage the bottom edges of successive envelopes received from said feeder means and convey said envelopes toward the container, and accelerator means disposed adjacent an exit end of said conveyor belt so as to receive documents conveyed along said conveyor belt, said accelerator means being operative to accelerate movement of said documents toward the container.

12. A conveying system as defined in claim 11 wherein said accelerator means includes at least one pair of accelerator rollers defining a nip adapted to receive documents from said conveyor belts and effect accelerated movement of said documents toward the container.

13. A conveying system as defined in claim 12 wherein at least one roller of said pair of accelerator rollers is rotatably driven in predetermined timed relation to said conveyor belts.

14. In a document conveying system for conveying generally flat documents along a path defined by first conveyor means operative to convey documents in generally upstanding on-edge relation to a predetermined position, the combination therewith comprising a sweeper assembly having a longitudinal axis and being operative to sweep successive documents from said predetermined position and convey said documents along a predetermined path to a container, said sweeper assembly including feeder means having a longitudinal axis and adapted to receive the lower edge of a document from said predetermined position and move the document in the direction of said longitudinal axis, second conveyor means including conveyor belt means operative to receive documents directly from said feeder means and convey said documents to a discharge position for deposit into the container, kicker means including a kicker arm disposed adjacent said first conveyor means and movable between a first position spaced from said conveyor path so as to enable passage of a document to said predetermined position, and a second position operative to engage a document disposed in said predetermined position and move said document to an orientation disposed substantially transverse to the longitudinal axis of said feeder means, said kicker arm being normally disposed in said second position inhibiting passage of a document along said conveying path to said predetermined position, and control means operative to detect the leading edge of a document approaching said predetermined position and move said kicker arm to said first position spaced from said conveyor path in response to detection of the leading edge of a document approaching said predetermined position.

15. A conveying system as defined in claim 4 wherein said control means is operative to detect the trailing edges of documents approaching said predetermined position and effect movement of said kicker arm to said second position to engage a document in response to detection of the trailing edge of a document approaching said predetermined position.

16. A conveying system as defined in claim 15 wherein said kicker arm is positioned to engage a document generally adjacent its trailing edge when actuated to move the document to an orientation disposed substantially transverse to the longitudinal axis of the sweeper assembly.

* * * * *